US008163256B2

(12) United States Patent
Cote et al.

(10) Patent No.: US 8,163,256 B2
(45) **Date of Patent: *Apr. 24, 2012**

(54) PIPETTE TIP MOUNTING AND EJECTION ASSEMBLY AND ASSOCIATED PIPETTE TIP

(75) Inventors: Richard A. Cote, Bolton, MA (US); Christopher P. LaCroix, Winchester, MA (US)

(73) Assignee: Matrix Technologies Corporation, Hudson, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/509,845

(22) Filed: Jul. 27, 2009

(65) Prior Publication Data

US 2009/0280033 A1 Nov. 12, 2009

Related U.S. Application Data

(62) Division of application No. 10/991,673, filed on Nov. 18, 2004, now Pat. No. 7,641,859.

(60) Provisional application No. 60/543,742, filed on Feb. 11, 2004.

(51) Int. Cl.
*B01L 3/02* (2006.01)

(52) U.S. Cl. ..... 422/524; 422/525; 422/511; 422/501; 422/931; 73/863.32; 73/864; 73/864.01; 73/864.14

(58) Field of Classification Search ..... 422/100, 422/931, 501, 511, 524–525; 436/180; 73/864.32, 73/864, 864.01, 864.14, 864.18, 86.32
See application file for complete search history.

(56) References Cited

U.S. PATENT DOCUMENTS

| | | | |
|---|---|---|---|
| 1,634,183 | A | 6/1927 | Gervais et al. |
| 2,172,575 | A | 9/1939 | Caulfield |
| 3,232,117 | A | 2/1966 | Gilmont |
| 3,525,264 | A | 8/1970 | Nieglos et al. |

(Continued)

FOREIGN PATENT DOCUMENTS

DE 199 17 375 A1 11/2000

(Continued)

OTHER PUBLICATIONS

Australian Government, IP Australia, Examiner's First Report on Patent Application No. 2005216853, mailed Jun. 15, 2009 (4 pages).

(Continued)

*Primary Examiner* — Brian R Gordon
(74) *Attorney, Agent, or Firm* — Wood, Herron & Evans, LLP

(57) ABSTRACT

An air displacement pipette has a tubular pipette tip with an upper section surrounding a locking chamber, and a body section leading from the upper section and tapering downwardly to a reduced diameter end. A tubular mounting shaft on the pipette has a distal end configured and dimensioned for axial insertion into the locking chamber of the pipette tip. Coacting surfaces on the distal end of the mounting shaft and the upper section of the pipette tip establish an axially interengaged relationship between the pipette tip and the mounting shaft in response to insertion of the distal end of the mounting shaft into the locking chamber. A sleeve is axially shiftable on the mounting shaft between a retracted position accommodating the establishment of the axially interengaged relationship, and an advanced position disrupting the axially interengaged relationship to thereby accommodate axial ejection of the pipette tip from the mounting shaft.

15 Claims, 10 Drawing Sheets

U.S. PATENT DOCUMENTS 3,646,817 A 3/1972 Hinchman et al.
3,732,734 A 5/1973 Avakian
3,995,496 A 12/1976 Bickford
4,036,064 A 7/1977 Hydo
4,072,330 A 2/1978 Brysch
4,140,488 A 2/1979 Mack et al.
4,154,108 A * 5/1979 Vollinger et al. ..... 73/864.13
4,250,755 A 2/1981 Kenney
4,261,205 A 4/1981 Oshikubo et al.
4,268,481 A 5/1981 Suovaniemi et al.
4,362,064 A 12/1982 Marteau d'Autry
4,369,665 A 1/1983 Citrin
4,399,712 A 8/1983 Oshikubo et al.
4,418,580 A 12/1983 Satchell et al.
4,474,071 A 10/1984 Marteau d'Autry
4,567,780 A 2/1986 Oppenlander et al.
4,616,514 A 10/1986 Magnussen, Jr. et al.
4,679,446 A 7/1987 Sheehan et al.
4,707,337 A 11/1987 Jeffs et al.
4,748,859 A 6/1988 Magnussen, Jr. et al.
4,824,641 A 4/1989 Williams
4,863,695 A 9/1989 Fullemann
4,905,526 A 3/1990 Magnussen, Jr. et al.
4,909,991 A 3/1990 Oshikubo
4,917,274 A * 4/1990 Asa et al. ..... 222/420
4,961,350 A 10/1990 Tennstedt
5,104,624 A 4/1992 Labriola
5,200,151 A 4/1993 Long
5,232,669 A 8/1993 Pardinas
5,364,596 A 11/1994 Magnussen, Jr. et al.
5,614,153 A 3/1997 Homberg
5,620,660 A 4/1997 Belgardt et al.
5,620,661 A 4/1997 Schürbrock
5,660,797 A 8/1997 Järvimäki
5,792,424 A 8/1998 Homberg et al.
5,827,745 A 10/1998 Astle
6,123,905 A 9/2000 Torti et al.
6,168,761 B1 1/2001 Kelly et al.
6,171,553 B1 1/2001 Petrek
6,197,259 B1 3/2001 Kelly et al.
6,248,295 B1 6/2001 Petrek
6,299,841 B1 10/2001 Rainin et al.
6,365,110 B1 4/2002 Rainin et al.
6,428,750 B1 8/2002 Rainin et al.
6,499,363 B1 12/2002 Morimoto et al.
6,499,364 B1 12/2002 Suovaniemi
6,550,349 B1 4/2003 Godin
6,596,240 B2 7/2003 Taggart et al.
6,702,990 B1 3/2004 Camacho et al.
6,780,381 B2 8/2004 Yiu
6,833,114 B1 12/2004 Christen et al.
6,871,557 B2 3/2005 Magnussen, Jr. et al.
6,923,938 B2 8/2005 Cote et al.
6,955,077 B2 * 10/2005 Blaszcak et al. ..... 73/73
6,967,004 B2 11/2005 Rainin et al.
7,033,543 B1 4/2006 Panzer et al.
7,047,828 B2 * 5/2006 Blaszcak et al. ..... 73/864.01
7,105,130 B2 9/2006 Telimaa et al.
7,175,813 B2 2/2007 Petrek et al.
7,335,337 B1 2/2008 Smith
7,344,680 B2 3/2008 Mahler et al.
7,641,859 B2 * 1/2010 Cote et al. ..... 422/522
2002/0001545 A1 1/2002 Cronenberg et al.
2002/0012613 A1 1/2002 Scordato et al.
2002/0092367 A1 7/2002 Bell
2002/0094302 A1 7/2002 Taggart et al.
2003/0000319 A1 1/2003 Rainin et al.
2003/0147781 A1 8/2003 Viot
2003/0219359 A1 11/2003 Lenz et al.
2005/0089450 A1 4/2005 Al-Mahareeq et al.
2005/0118069 A1 6/2005 Solotareff et al.
2005/0158214 A1 7/2005 Cote et al.

FOREIGN PATENT DOCUMENTS

EP 0 733 404 A1 9/1996

OTHER PUBLICATIONS

European Patent Office, Search Report and Examiner's Preliminary Opinion, European Patent Application No. 10179875.9, Feb. 8, 2011 (5 pages).

* cited by examiner

PIPETTE TIP MOUNTING AND EJECTION ASSEMBLY AND ASSOCIATED PIPETTE TIP

CROSS REFERENCE TO RELATED APPLICATIONS

This application is a divisional of co-pending U.S. patent application Ser. No. 10/991,673, filed Nov. 18, 2004, which claims the filing benefit of U.S. patent application Ser. No. 60/543,742, filed Feb. 11, 2004, now expired, the disclosures of which are hereby incorporated herein by reference in their entireties.

BACKGROUND OF THE INVENTION

1. Field of the Invention

This invention relates generally to air displacement pipettes, and is concerned in particular with an improvement in pipette tips and the manner in which they are releasably retained on and ejected from the tubular mounting shafts of the pipettes.

2. Description of the Prior Art

It is known to detachably retain a pipette tip on the tubular mounting shaft of an air displacement pipette. The pipette is equipped with a manually operable ejection mechanism for disengaging and releasing the thus retained pipette tip once it has served its purpose. Retention is commonly achieved by effecting a friction fit between coacting surfaces on the pipette tip and the mounting shaft.

This leads to certain difficulties in that users are often uncertain as to the level of force required to achieve a secure friction fit. An inadequate force can result in the pipette tip becoming prematurely dislodged, whereas an excessive force can result in the pipette tip being jammed in place, which in turn disadvantageously increases the force that must be exerted by the manually operable ejection mechanism when dislodging the pipette tip from its retained position. These problems are exacerbated in multi channel pipettes.

It is also known to provide the cylindrical walls defining the upper ends of the pipette tips with interiorly projecting circular ribs or ridges designed to coact in snap engagement with mating surfaces on the tubular mounting shafts of the pipettes.

However, this also leads to certain difficulties in that in order to achieve a snap engagement, the upper walls of the pipette tips must be radially expanded, which in turn requires the user to exert unacceptably high forces when axially inserting the tubular mounting shafts into the pipette tips. Comparable forces are required to disengage the tips from the mounting shafts. Moreover, slight dimensional variations can have a significant impact, e.g., by either additionally increasing the forces required to engage and release the pipette tips if their internal wall diameters are too small, or resulting in unacceptably loose connections if their internal wall diameters are too large.

SUMMARY OF THE INVENTION

In accordance with one aspect of the present invention, a tubular pipette tip has an upper section surrounding a locking chamber. A tubular mounting shaft on an air displacement pipette has a distal end configured and dimensioned for insertion into an axially interengaged relationship with the upper section. A spring loaded ejection sleeve is manually shiftable on the pipette mounting shaft between a retracted position accommodating establishment of the aforesaid axially interengaged relationship, and an advanced position disrupting that relationship to thereby accommodate axial ejection of the pipette tip from the pipette mounting shaft.

In accordance with another aspect of the present invention, a spring loaded collar on the ejection sleeve serves to forcibly eject the pipette tip from the mounting shaft when the axially interengaged relationship is disrupted. The spring loaded collar also serves to eject a pipette tip that has not been fully inserted to establish its axially interengaged relationship with the mounting shaft.

In accordance with still another aspect of the present invention, a tubular pipette tip has a body section tapering downwardly from its upper section to a reduced diameter end. The upper section of the pipette tip is provided with at least one and preferably a plurality of integral circumferentially spaced resilient fingers that project inwardly into the locking chamber to coact in snap engagement with a complimentary surface on the distal end of the mounting shaft.

These and other aspects, features and advantages of the present invention will now be described in greater detail with reference to the accompanying drawings, wherein:

DETAILED DESCRIPTION OF PREFERRED EMBODIMENTS

Figure 1:
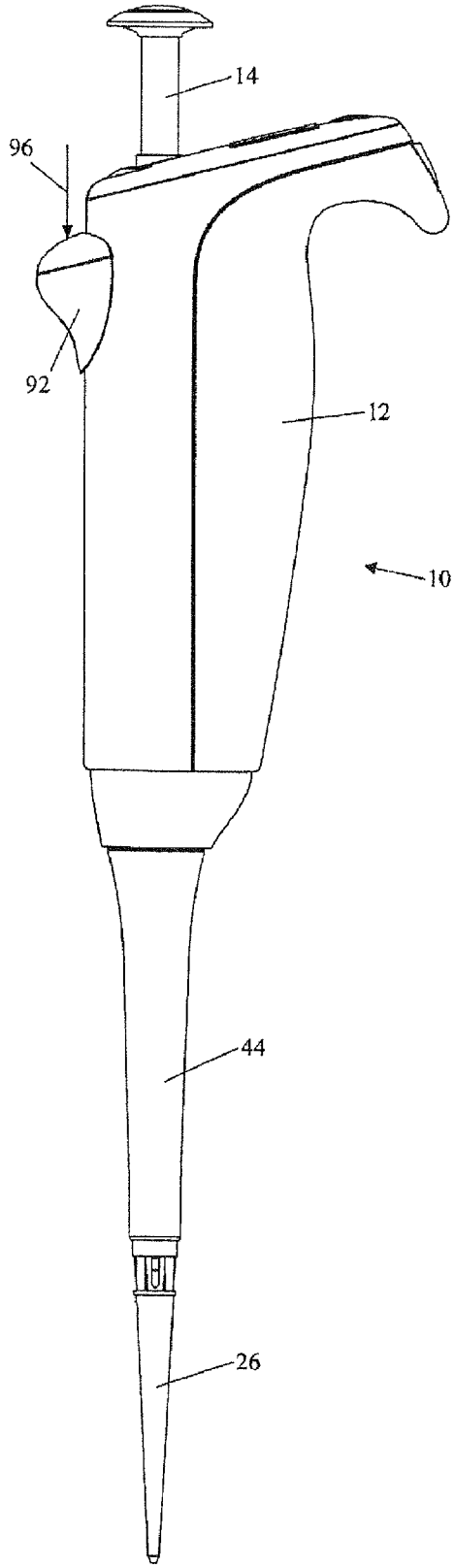
FIG. 1 is a side view of a manually operable air displacement pipette incorporating the concepts of the present invention.
Figure 2:
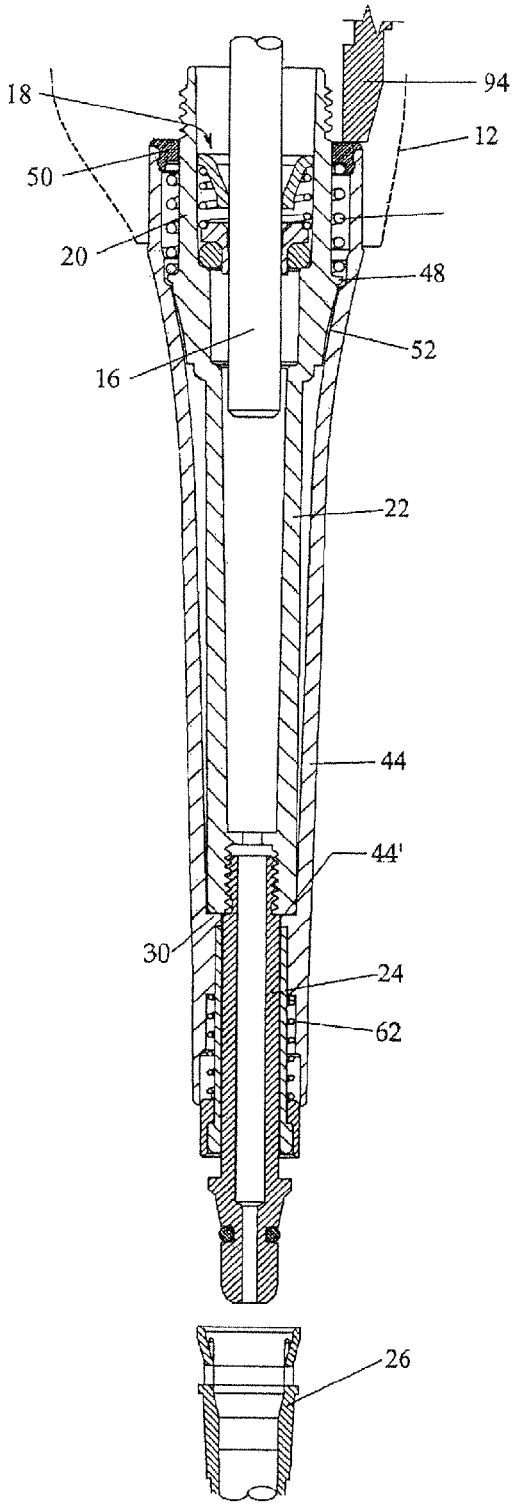
FIG. 2 is an enlarged vertical sectional view through the tip mounting and ejection assembly of the pipette illustrated in FIG. 1, with the pipette tip separated therefrom.
Figure 3:
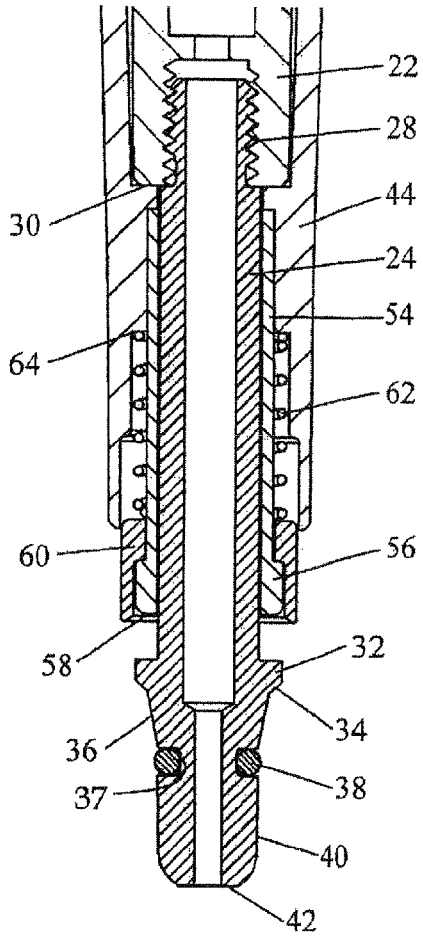
FIG. 3 is a further enlarged vertical sectional view of the end portion of the tip mounting and ejection assembly shown in FIGS. 1 and 2.
Figure 4:
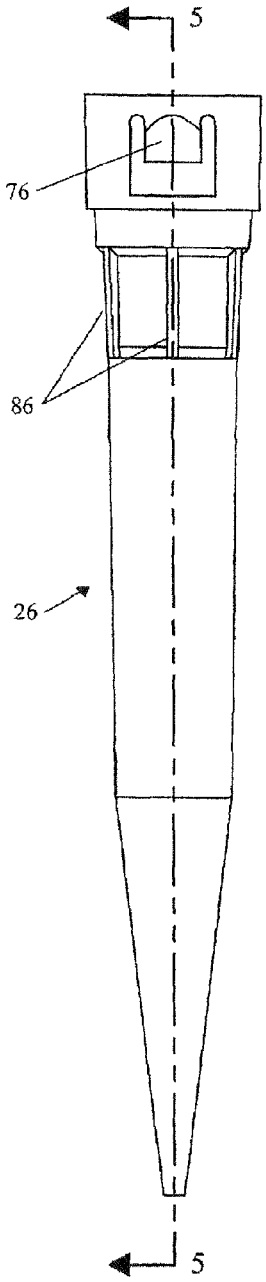
FIG. 4 is a side view of the pipette tip shown in FIGS. 1 and 2.
Figure 5:
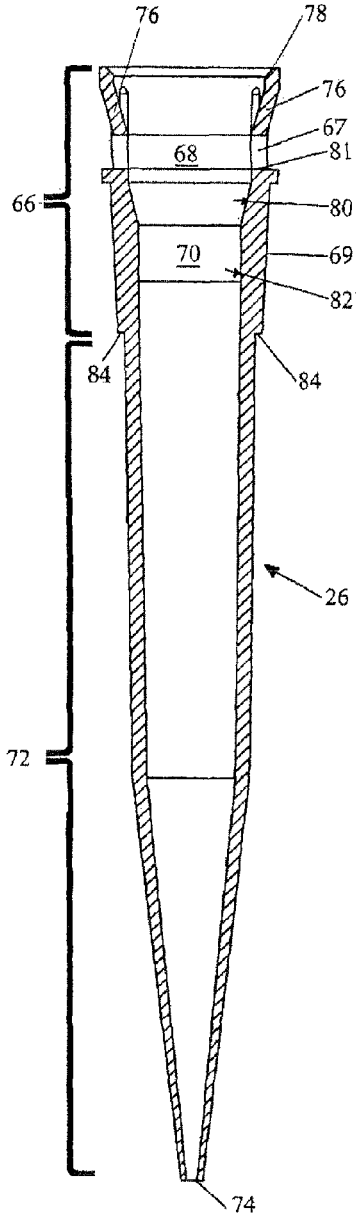
FIG. 5 is a vertical sectional view of the pipette tip taken on line 5-5 of FIG. 4.
Figure 6:
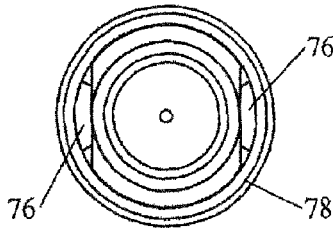
FIG. 6 is a top plan view of the pipette tip.
Figure 7:
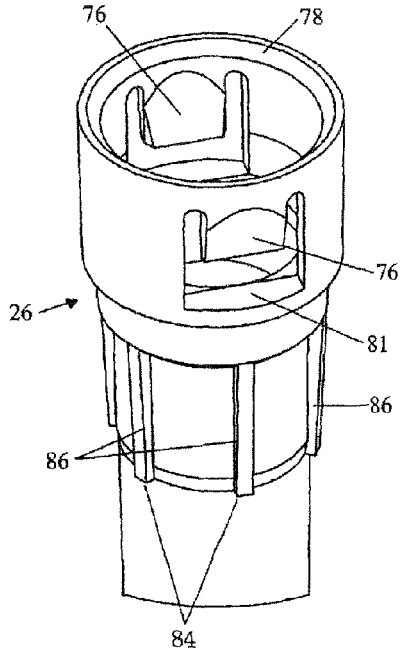
FIG. 7 is a perspective view of the crown section of the pipette tip.

With reference initially to FIGS. 1-3, a manually operable air displacement pipette incorporating concepts of the present invention is generally depicted at 10. The pipette includes a housing 12 with a manually operable push button 14 at its upper end. The push button is connected via internal components (not shown) to a piston 16 projecting from the lower end of the housing. The piston 16 extends through a seal assembly 18 contained in the enlarged diameter head 20 of an aspirating and dispensing cylinder 22. The cylinder is threaded into the lower end of the housing and communicates with an integral tubular mounting shaft 24 with a distal end configured and dimensioned to removably retain a disposable pipette tip 26.

As can best be seen in FIG. 3, the mounting shaft 24 is threaded into the cylinder end as at 28, with its reduced diameter coacting with the end of the cylinder 22 to form a circular shoulder 30. The distal end of the mounting shaft 24 is externally configured with an enlarged diameter shoulder 32 optionally having a chamfered leading edge 34. An intermediate surface 36 tapers inwardly from shoulder 32 to a circular groove 37 containing a resilient O-ring seal 38. A cylindrical section 40 extends from the groove 37 to an end surface 42.

A sleeve 44 surrounds the aspirating and dispensing cylinder 22 and its tubular shaft extension 24. As can best be seen in FIG. 2, the upper end of sleeve 44 is spaced radially from the exterior surface of cylinder head 20 to define an annular space containing a first coiled compression spring 46. The spring 46 is axially confined between an external shoulder 48 on cylinder head 20 and a spring retainer 50 snap fitted into the upper sleeve end. Spring 46 resiliently urges sleeve 44 into a retracted position at which an internal sleeve shoulder 44' contacts the shoulder 30.

Sleeve 44 includes a cylindrical press fitted insert 54 formed with an enlarged diameter end 56 having a chamfered or radiused leading edge 58. A collar 60 surrounds and is axially shiftable on the sleeve insert 54.

The lower interior of sleeve 44 is spaced radially from the exterior of insert 54 to define an annular spaced containing a second coiled compression spring 62. Spring 62 is axially confined between an internal shoulder 64 on sleeve 44 and the collar 60. The spring 62 serves to resiliently urge the collar 60 against the enlarged diameter end 56 of sleeve insert 54.

As can best be seen in FIGS. 4-7, the pipette tip 26 has a tubular configuration with an upper section having an upper wall segment 67 surrounding a locking chamber 68 and a lower wall segment 69 surrounding a sealing chamber 70. A body section 72 extends downwardly from the upper section 66 to a reduced diameter open end 74. The upper wall segment 67 of section 66 is formed with at least one and preferably a plurality of circumferentially spaced resilient fingers 76. Preferably, as shown, a pair of resilient fingers 76 are provided in an oppositely disposed relationship. The fingers 76 border and project inwardly in cantilever fashion from an upper chamfered rim 78 into the locking chamber 68. The lower wall segment 69 is interiorly provided with an entry section 80 tapering inwardly to a cylindrical section 82. A stop surface in the form of a circular ledge 81 is located between the locking chamber 68 and the sealing chamber 70. As can best be seen in FIGS. 5 and 7, the lower wall segment is reinforced by external circumferentially spaced ribs 86 extending from ledge 80 to the body section 72. The lower ends 84 of external vertical ribs 86 lie on a plane demarcating the upper crown section 66 from the body section 72.

Figure 8:
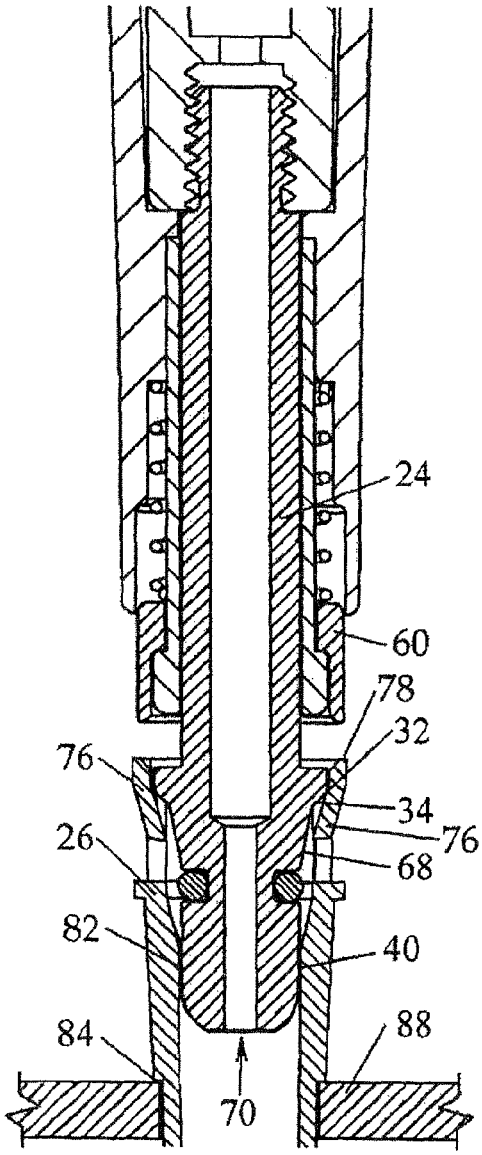
FIGS. 8-11 are views similar to FIG. 3 showing successive stages in the tip mounting and ejection sequence.

A tip mounting sequence will now be described with initial reference to FIG. 8 where a pipette tip 26 is shown supported on the lower ends 84 of ribs 86 in the aperture of a support plate 88 or the like. The pipette 10 is first aligned with the tip 26 and then lowered, causing the cylindrical end 40 of the mounting shaft 24 to pass axially through the locking chamber 68 into the sealing chamber 70. The shoulder 32, aided by its chamfered leading edge 34, makes initial contact with the resilient fingers 76 and begins to deflect them outwardly.

Figure 9:
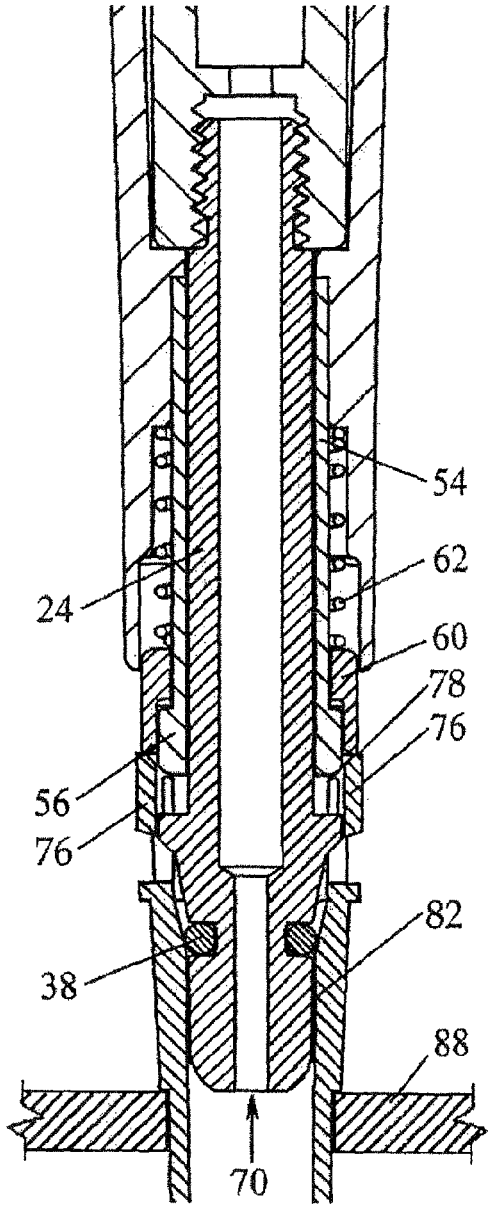

FIG. 9 shows an intermediate stage in the mounting sequence at which axial insertion of the mounting shaft 24 has progressed to the point where the resilient fingers 76 are now fully expanded, the O-ring seal 38 is about to enter into sealing engagement with the cylindrical section 82 of the sealing chamber 70, and the collar 60 has encountered the upper rim 78 of the pipette tip and has begun to shift axially against the compressive force of spring 62 and away from the enlarged diameter end 56 of sleeve insert 54.

Figure 10:
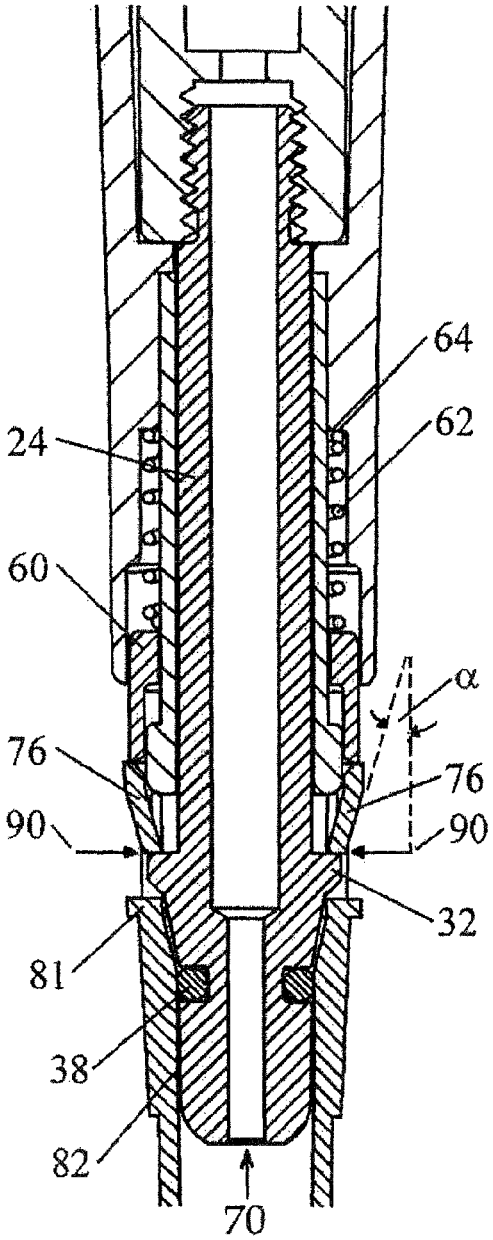

FIG. 10 shows the final stage in the mounting sequence. As indicated by the arrows 90, the resilient fingers 76 have now snapped inwardly behind and in locked interengagement with the shoulder 32 on mounting shaft 24. Spring 62 has been compressed and loaded to an elevated level between shoulder 64 and collar 60. A fluid-tight seal has been established between the O-ring seal 38 and the cylindrical section 82 of the sealing chamber 70, and the shoulder 32 has bottomed out against the circular ledge 81. The ledge 81 thus establishes a positive stop, which in combination with the audible sound of the fingers 76 snapping into interlocked engagement, provides the user with a reliable indication that the pipette tip has been securely mounted. Because of the angle a of inward inclination of the interlocked fingers, any attempt to pull the pipette tip off of the mounting shaft 24 will only serve to further deflect the fingers inwardly, thus enhancing the interlocked relationship between the pipette tip and the cylinder extension.

With reference again to FIGS. 1 and 2, it will be seen that the pipette 10 further includes an ejection button 92 connected via a mechanical linkage (not shown) contained in housing 12 to a link 94 bearing against the spring retainer 50. Tip ejection is effected by manually pushing button 92 in the direction of arrow 96, resulting in a corresponding axial shifting of link 94, causing sleeve 44 to shift axially in the same direction on cylinder 24 against the compressive force of springs 46 and 62.

Figure 11:
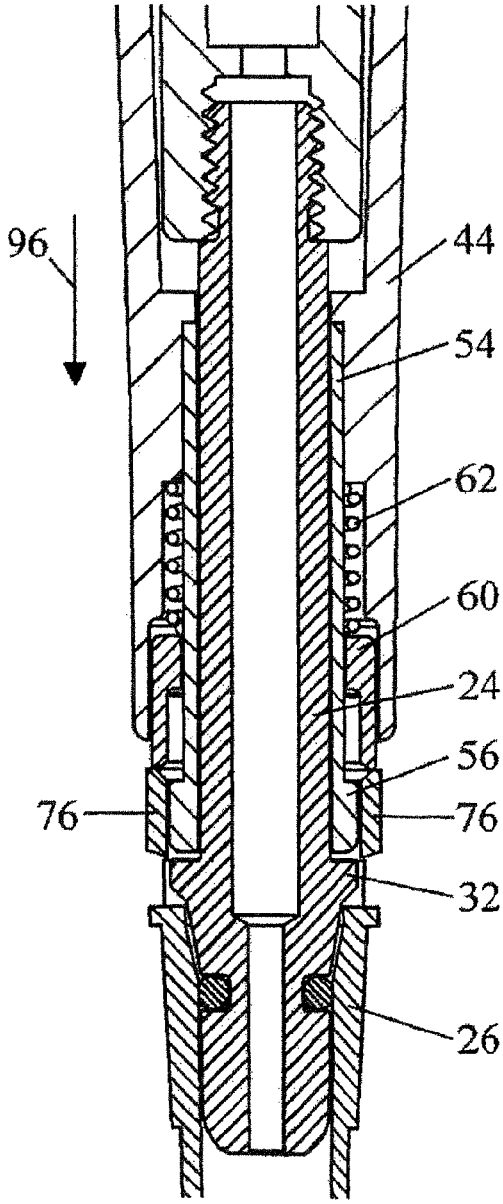

FIG. 11 shows that as the sleeve 44 and its insert 54 shift in the direction of arrow 96, the resilient fingers 76 are biased outwardly by the enlarge diameter end 56 of insert 54. When the fingers are deflected outwardly beyond the shoulder 32, the axially interengaged relationship between the pipette tip 26 and the mounting shaft 24 is disrupted, allowing the spring 62, now loaded to an elevated level, to act via collar 60 to forcibly eject the tip 26 from the end of the mounting shaft. The spring loaded collar will also serve to forcibly eject a pipette tip that has not been fully inserted, e.g., inserted only to the extent shown in FIG. 9.

It thus will be seen that in order to effect tip ejection, a user need only press button 92 with a force necessary to overcome the resistance of springs 46 and 62. Appropriate spring selection will insure that this force is modest and ergonomically friendly.

In light of the foregoing, those skilled in the art will appreciate that the tip mounting and ejection assembly of the present invention is not limited in use to manually operable pipettes of the type herein disclosed, and that the concepts of the present invention are applicable to a wide range of mechanically and/or automatically driven pipette types and designs.

Figure 12A:
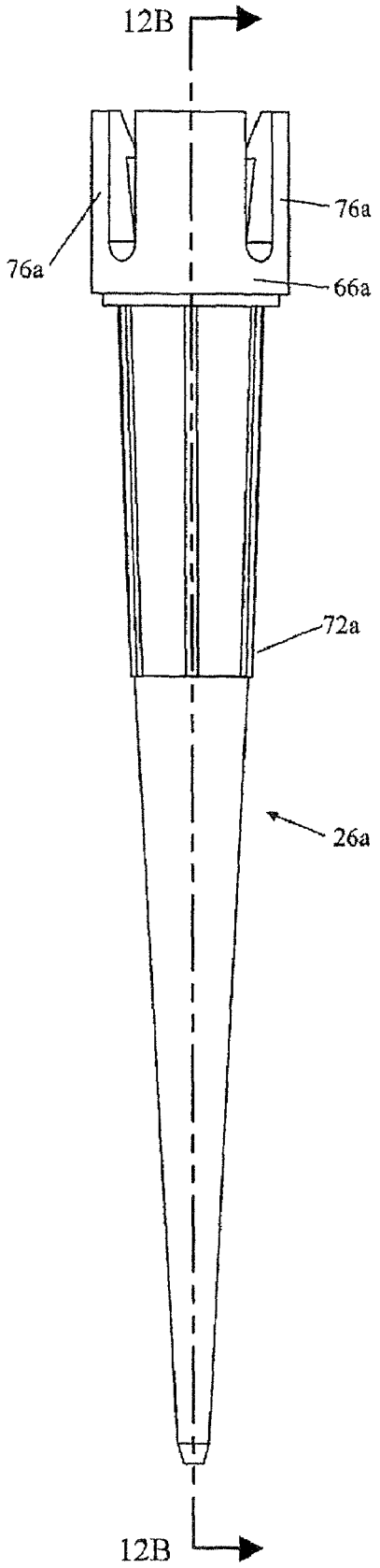
FIGS. 12A, 13A, 14A and 15A are side views of alternative pipette tip embodiments.
Figure 12B:
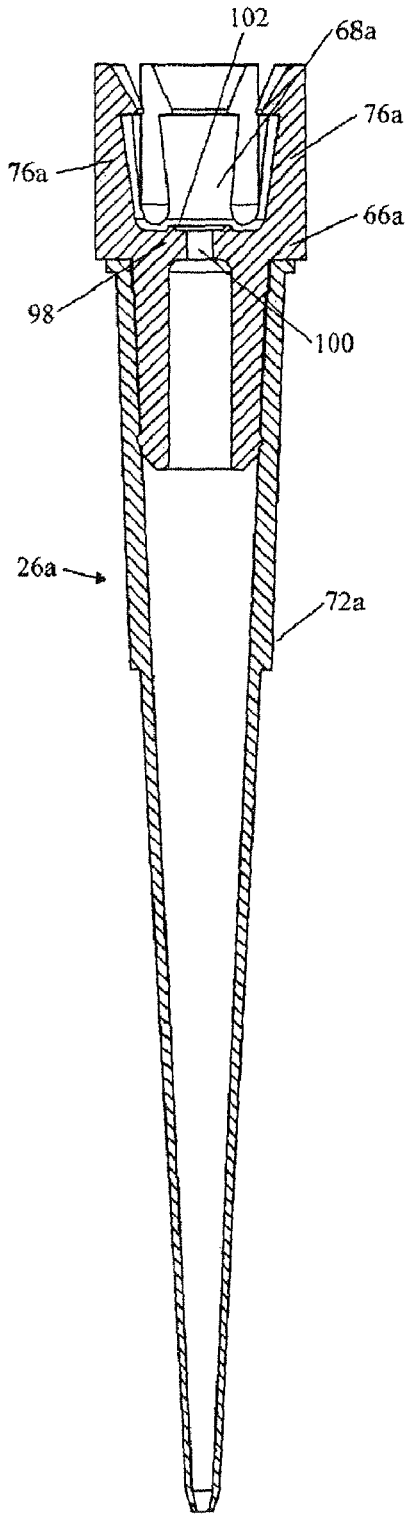
FIGS. 12B, 13B, 14B and 15B are vertical sectional views, respectively, of the pipette tip embodiments shown in FIGS. 12A, 13A, 14A and 15A.

It should also be understood that various pipette tip designs may be employed with the above described mounting and ejection assembly. For example, in the tip embodiment shown at **26*a* in FIGS. 12A and 12B, although the upper section 66*a* of the tip again surrounds a locking chamber 68*a*, it is formed separately from and assembled as an insert into the upper end of the body section 72*a*. The resilient fingers 76*a* project in cantilever fashion upwardly from a circular base at the bottom of the locking chamber, and an internal shelf 98 has a through bore 100 surrounded by a raised bead 102 projecting upwardly into the locking chamber 68*a*. With this embodiment, the end surface 42 of the mounting shaft 24 will coact in sealing engagement with the raised bead 102, making it unnecessary to employ an O-ring seal 38**.

Figure 13A:
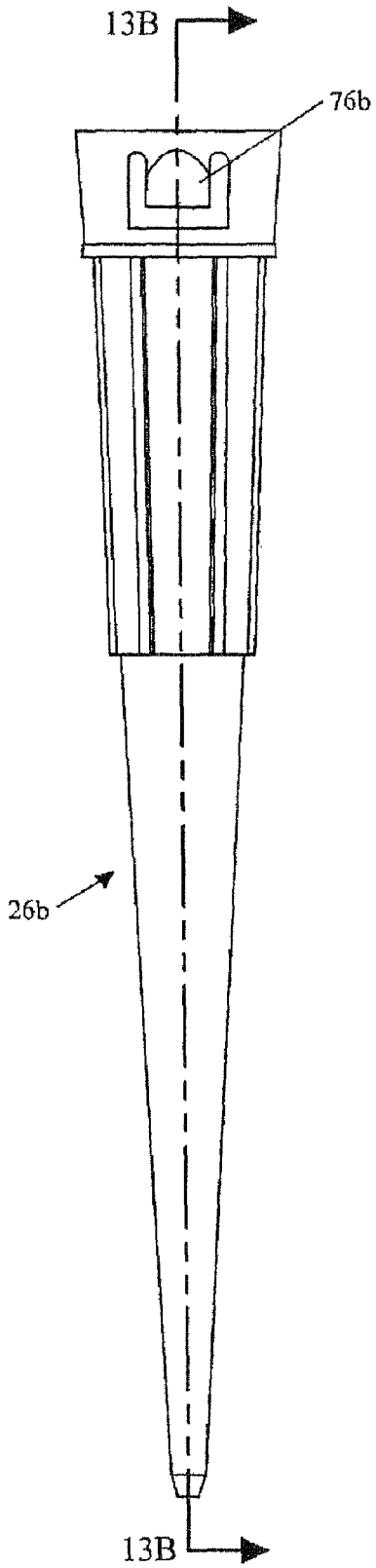
Figure 13B:
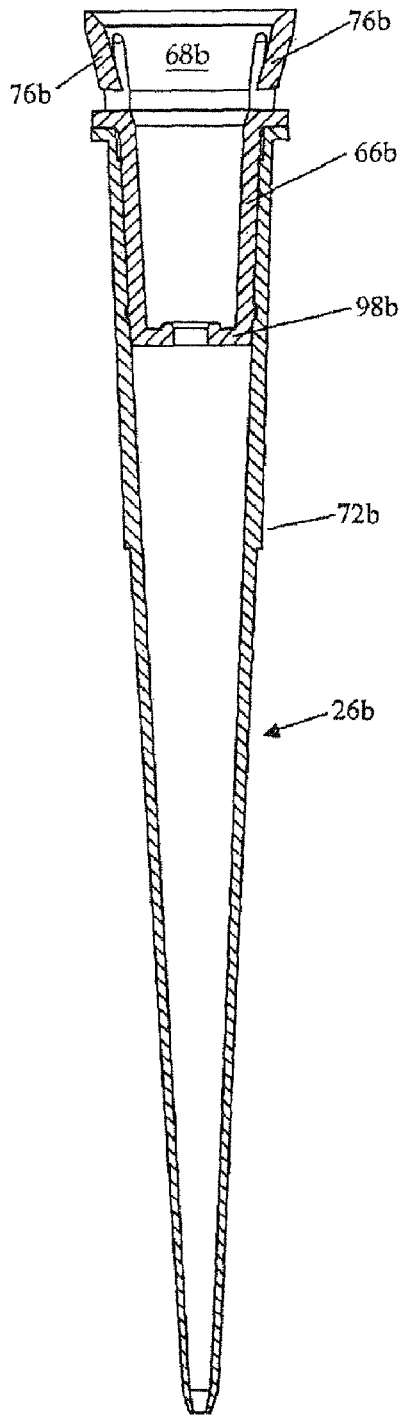

In another pipette tip embodiment **26*b* shown in FIGS. 13A and 13B, the upper section 66*b* includes a locking chamber 68*b* and a lower sealing chamber 70*b*, and is again formed separately and assembled as an insert into the upper end of body section 72***b*. The resilient fingers 76*b* project downwardly and inwardly in cantilever fashion from a top rim into the locking chamber 68*b*, and the internal shelf 98*b* is located at the bottom of the upper section.

Figure 14A:
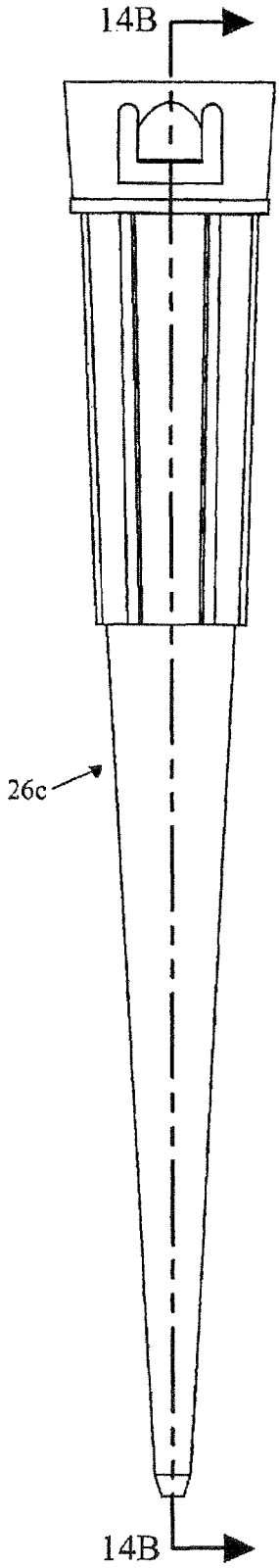
Figure 14B:
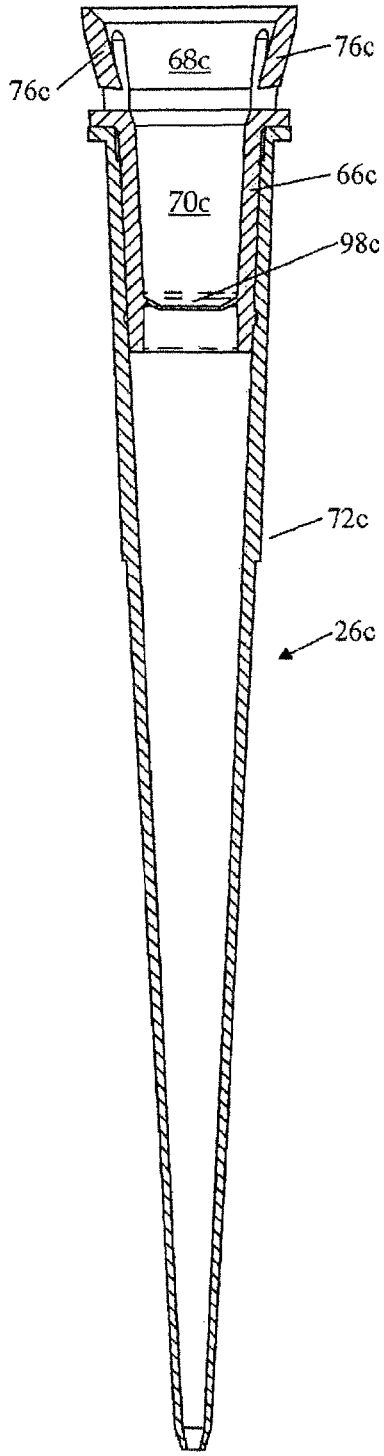

In FIGS. 14*a* and 14*b*, the pipette tip 26*c* is similar to that shown in FIGS. 13A and 13B, except that here the internal shelf 98*c* is formed as a thin apertured membrane designed to coact in sealing engagement with the end surface 42 of the mounting shaft 24.

Figure 15A:
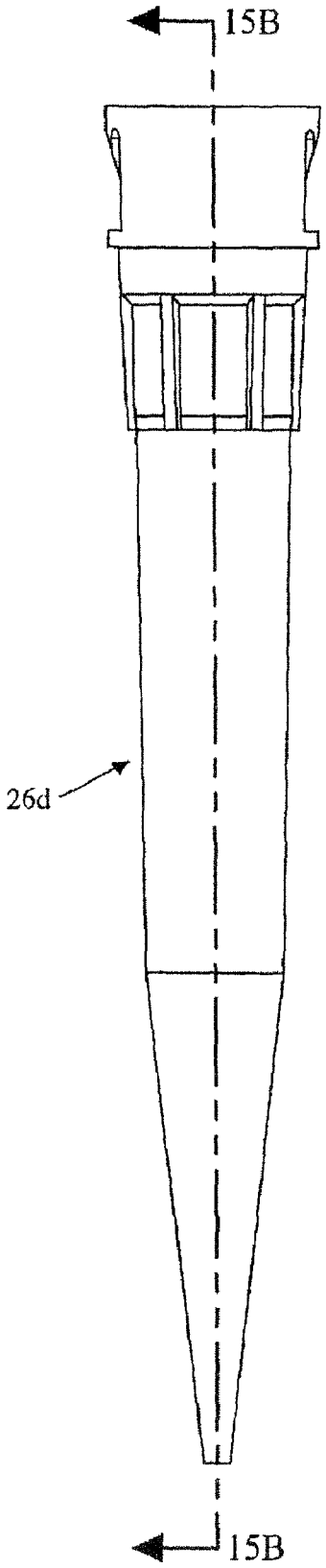
Figure 15B:
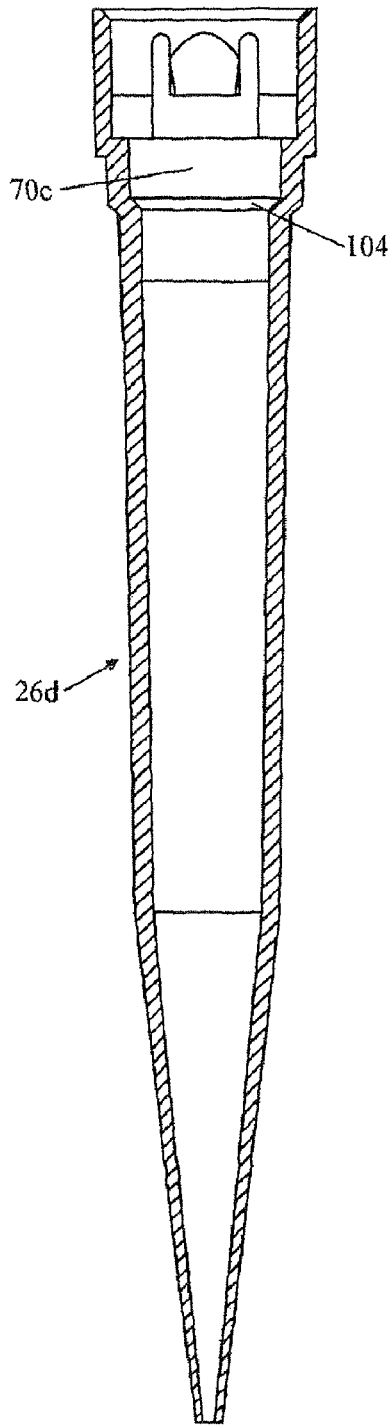

In FIGS. 15A and 15B, the pipette tip 26*d* is similar to that depicted in FIGS. 4-7, except that here the sealing chamber 70*c* is bordered by an angled ledge 104 positioned to coact in sealing engagement with the O-ring seal 38 on the tubular shaft extension 24.

Figure 16:
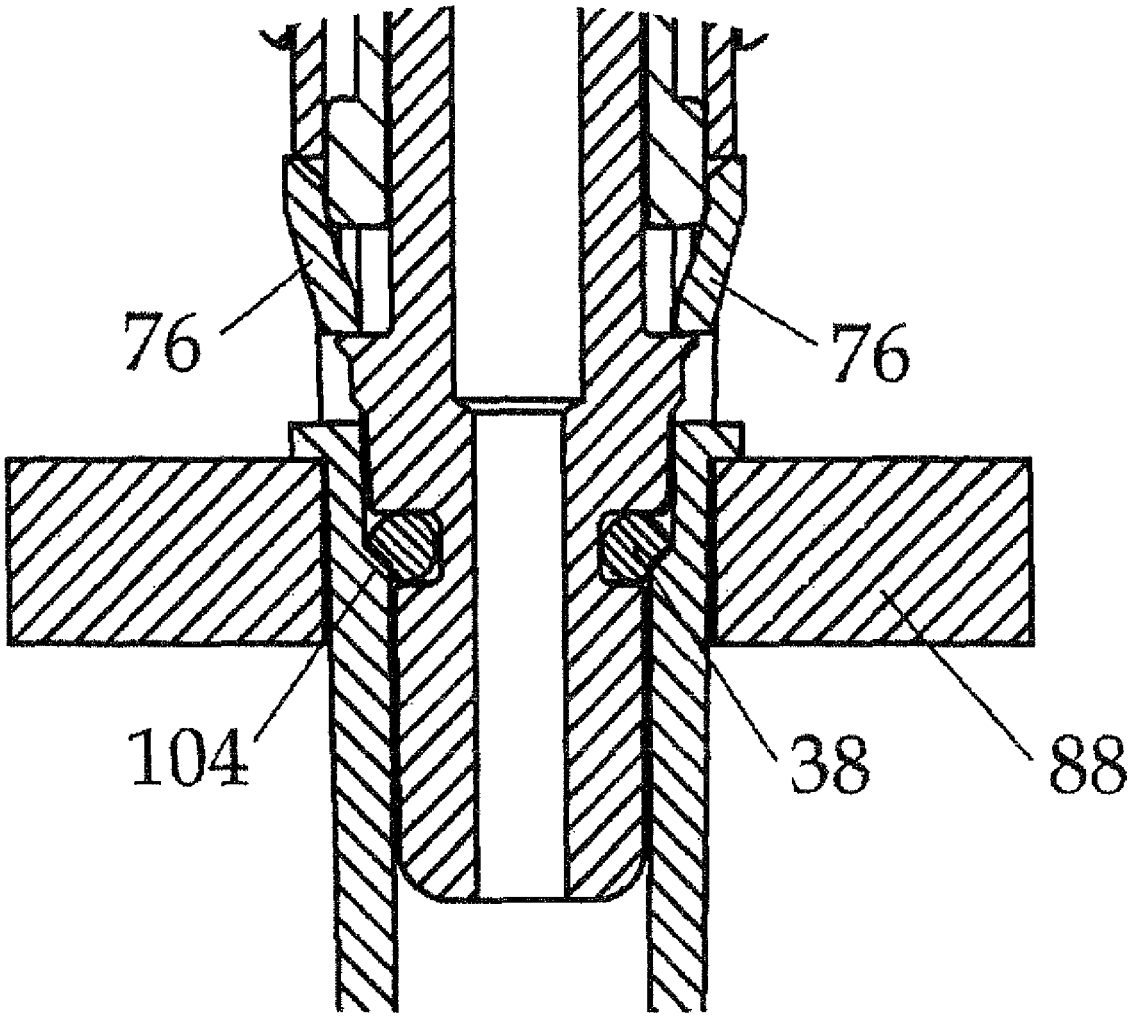
FIG. 16 is a partial sectional view showing the pipette tip of FIGS. 15A and 15B axially interengaged with the mounting shaft of the pipette.

As shown in FIG. 16, the O-ring 38 coacts in a "face sealing" relationship with the angled ledge 104, without disadvantageously increasing frictional resistance to subsequent ejection of the tip from the mounting shaft.

In light of the foregoing it will now be understood by those skilled in the art that the mounting shaft 24 of the pipette and each of the several pipette tip embodiments 26*a*-26*d* are respectively configured and dimensioned to effect an axially interengaged relationship and a snap connection between a shoulder 32 or the like on the former and resilient fingers on the crown sections of the latter. A positive stop on the pipette tip limits the extent of mounting shaft insertion required to achieve the snap connection, and this, together with the audible nature of the snap connection, provides the user with a reliable indication that an adequate insertion force has been exerted, and that the pipette tip has been reliably and securely retained on the mounting shaft.

Tip ejection requires only a modest force exerted on button 92 and transmitted to sleeve insert 54 to spread the resilient fingers 76 sufficiently to disrupt their interengaged relationship with the mounting shaft 24. The pipette tip is then freed for forcible ejection by the spring loaded collar 60.

We claim:

1. A tubular pipette tip for use with a pipette having a mounting shaft defining a first coacting surface, the pipette tip comprising:

an upper section;

a locking chamber surrounded by said upper section;

a body section leading from said upper section and tapering downwardly to a reduced diameter end; and at least two elongated, resilient fingers each having a second coacting surface and projecting in cantilever fashion into said locking chamber, said at least two resilient fingers being discrete and circumferentially spaced about said upper section with said at least two resilient fingers and their respective associated second coacting surfaces being deflectable relative to said upper section and configured to engage the first coacting surface such that said pipette tip is mechanically interlocked in snap engagement with the pipette when said pipette tip is received on the mounting shaft.

2. The pipette tip of claim 1 wherein said respective second coacting surfaces are provided on said at least two resilient fingers that project downwardly and inwardly from an upper rim of the upper section.

3. The pipette tip of claim 1 wherein a plurality of resilient fingers are integral with said upper section.

4. The pipette tip of claim 1 wherein said upper section and said body section are integral.

5. The pipette tip of claim 1 wherein said upper section and said body section are separate units, and wherein said upper section is assembled as an insert into an upper end of said body section.

6. The pipette tip of claim 1 wherein said upper section includes an upper wall segment surrounding said locking chamber, a lower wall segment, and a sealing chamber surrounded by said lower wall segment, said sealing chamber being configured to establish a seal with the mounting shaft of the pipette.

7. The pipette tip of claim 6 wherein said lower wall segment includes an entry section tapering inwardly and downwardly to a cylindrical section leading to said body section.

8. The pipette tip of claim 6 wherein said upper section includes a stop surface comprising a circular ledge between said locking chamber and said sealing chamber, said stop surface being configured to engage and establish a positive stop with the mounting shaft of the pipette.

9. The pipette tip of claim 6 wherein said lower wall segment is provided with external circumferentially spaced vertical ribs.

10. The pipette tip of claim 8 wherein said lower wall segment is provided with external circumferentially spaced ribs.

11. The pipette tip of claim 1 wherein said respective second locking surfaces are provided on said at least two resilient fingers that project upwardly from a bottom of said locking chamber.

12. The pipette tip of claim 1 wherein said upper section includes a circular base defining an internal shelf at a bottom of said locking chamber, said shelf having a through bore.

13. The pipette tip of claim 12 wherein said through bore is surrounded by a raised bead projecting upwardly from said internal shelf into said locking chamber.

14. The pipette tip of claim 1 wherein said upper section is provided with an internal chamfered surface bordering said locking chamber.

15. The pipette tip of claim 1 wherein said at least two resilient fingers project in cantilever fashion into said locking chamber at respective angles of inclination relative to said upper section.

* * * * *